US008288928B2

(12) United States Patent
Kumagai et al.

(10) Patent No.: US 8,288,928 B2
(45) **Date of Patent: *Oct. 16, 2012**

(54) SPARK PLUG FOR INTERNAL COMBUSTION ENGINE

(75) Inventors: Kenichi Kumagai, Nagoya (JP); Teruyuki Kondo, Kasugai (JP); Kozo Amano, Nagoya (JP); Kazuo Yamazaki, Osaka (JP); Yoshihiro Nakai, Osaka (JP); Masatada Numano, Osaka (JP)

(73) Assignees: NGK Spark Plug Co., Ltd., Aichi (JP); Sumitomo Electric Industries, Ltd., Osaka (JP)

( * ) Notice: Subject to any disclaimer, the term of this patent is extended or adjusted under 35 U.S.C. 154(b) by 81 days.

This patent is subject to a terminal disclaimer.

(21) Appl. No.: 12/889,294

(22) Filed: Sep. 23, 2010

(65) Prior Publication Data

US 2011/0012500 A1 Jan. 20, 2011

Related U.S. Application Data

(63) Continuation of application No. 11/341,623, filed on Jan. 30, 2006, now Pat. No. 7,825,571.

(30) Foreign Application Priority Data

Jan. 31, 2005 (JP) ..... 2005-024500
Nov. 30, 2005 (JP) ..... 2005-345337

(51) Int. Cl.
*H01T 13/30* (2006.01)

(52) U.S. Cl. ..... 313/118

(58) Field of Classification Search ..... 313/118–145
See application file for complete search history.

(56) References Cited

U.S. PATENT DOCUMENTS

| | | | | |
|---|---|---|---|---|
| 4,742,265 | A | 5/1988 | Giachino et al. | |
| 5,204,059 | A | 4/1993 | Sahira et al. | |
| 6,236,148 | B1 | 5/2001 | Nasu et al. | |
| 7,825,571 | B2 * | 11/2010 | Kumagai et al. | 313/118 |
| 2004/0013560 | A1 | 1/2004 | Hrastnik | |

FOREIGN PATENT DOCUMENTS

| | | | |
|---|---|---|---|
| EP | 0 269 267 | A1 | 6/1988 |
| JP | 63-138681 | A | 6/1988 |
| JP | 64-87738 | A | 3/1989 |
| JP | 2-163335 | A | 6/1990 |
| JP | 4-45239 | A | 2/1992 |
| JP | 2000-336446 | A | 12/2000 |
| JP | 2003-249326 | A | 9/2003 |
| JP | 2004-11024 | A | 1/2004 |
| JP | 2004-206892 | A | 7/2004 |
| JP | 2004-206931 | A | 7/2004 |
| WO | 00/00652 | A1 | 1/2000 |

* cited by examiner

*Primary Examiner* — Nimeshkumar Patel
*Assistant Examiner* — Christopher Raabe
(74) *Attorney, Agent, or Firm* — Sughrue Mion, PLLC

(57) ABSTRACT

A spark plug comprising: a cylindrical metal shell; a cylindrical insulator provided in an inner hole of said metal shell; a center electrode provided in a leading end side inner hole of said insulator; and a ground electrode having one end bonded to a leading end side of said metal shell and having another end face forming a spark discharge gap with said center electrode, wherein said ground electrode comprises an electrode material containing from 0.5 to 1.5 wt. % of Si, from 0.5 to 1.5 wt. % of Al, from 0.02 to 1.0 wt. % of at least one of Ti, V, Zr, Nb and Hf, from 0.03 to 0.09 wt. % of C and 95.5 wt. % or more of Ni, and having a specific resistance at 20° C. of 25 tincm or less.

9 Claims, 1 Drawing Sheet

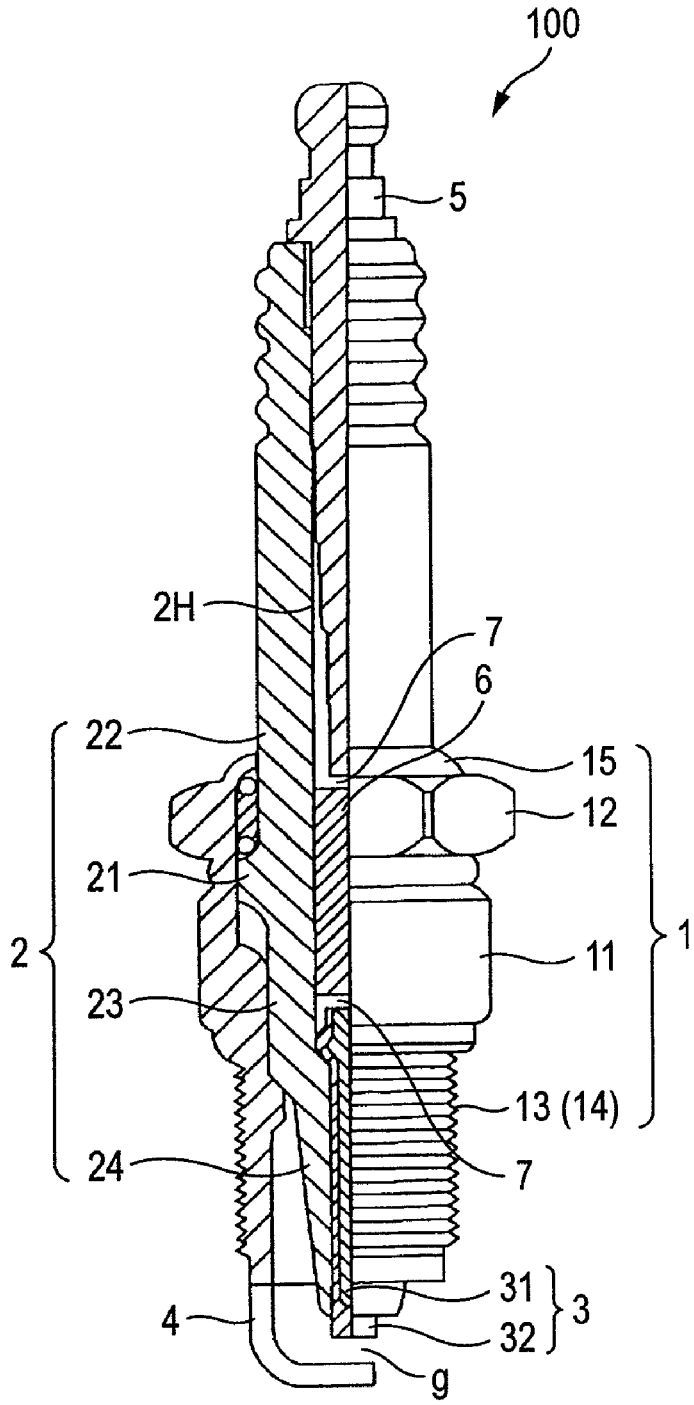
100
5
2H
7
6
22
15
12
21
2
11
1
23
13 (14)
24
7
31
3
4
32
9

SPARK PLUG FOR INTERNAL COMBUSTION ENGINE

CROSS-REFERENCE TO RELATED APPLICATIONS

This application is a Rule 53(b) Continuation of U.S. application Ser. No. 11/341,623 filed Jan. 30, 2006 (now U.S. Pat. No. 7,825,571), which claims foreign priority based on Japanese Patent Application No. 2005-024500 filed Jan. 31, 2005 and Japanese Patent Application No. 2005-345337 filed Nov. 30, 2005. The above-noted applications are incorporated herein by reference in their entirety.

FIELD OF THE INVENTION

The present invention relates to a spark plug for use in an internal combustion engine and, more particularly, to a spark plug for use in an internal combustion engine which can be plated with zinc to have an excellent rust prevention.

BACKGROUND OF THE INVENTION

The spark plug for use in internal combustion engine to be employed for igniting the internal combustion engine such as an automotive engine is generally provided with: a cylindrical metal shell; a cylindrical insulator provided in the inner hole of the metal shell; a center electrode provided in the leading end side inner hole of the insulator; and a ground electrode having one end bonded to the leading end side of the metal shell and having another end face forming a spark discharge gap together with the center electrode.

As the electrode material to be used as the center electrode and the ground electrode of the spark plug for use in internal combustion engine, there has been known an alloy group, which is called the M-CrAlY, for example. Here, M is a composite material which is composed of Ni (nickel), Co (cobalt) or Fe (iron), or a composite of Ni, Co and Fe such as NiCo or FeCo, and which contains Cr (chromium) in 15 to 30 wt. %, Al (aluminum) in 5 to 15 wt. %, and Y (yttrium) in about 0 to 2 wt. % (as referred to JP-A-63-138681, for example).

There are also known: a Ni-group alloy (as referred to JP-A-64-87738, for example), in which 0.5 to 1.5 wt. % of Si, 0.7 to 2.8 wt. % of Mn, and 0.25 to 4.5 wt. % of Al are added to Ni; a Ni-group alloy (as referred to JP-A-4-45239, for example), in which 1.0 to 2.5 wt. % of Si, 0.5 to 2.5 wt. % of Cr, 0.5 to 2.0 wt. % of Mn, and 0.6 to 2.0 wt. % of Al are added to Ni; and a Ni-group alloy (as referred to JP-A-2004-11024, for example), in which 1.8 to 2.2 wt. % of Si, 0.05 to 0.1 wt. % of one or more kinds selected from Y, Hf and Zr, and 2 to 2.4 wt. % of Al are added to Ni. These individual components in the electrode material of the spark plug for use in internal combustion engine are added to improve the sulfur-resistance, corrosion resistance to lead, and high-temperature oxidation resistance and to suppress the electrode decrease by the spark discharge thereby to improve durability.

In recent years, the purification of fuels has advanced considering the influences on the environment to reduce the sulfur components and the lead components in the fuels so that the demands of the sulfur resistance and the lead resistance for the electrode of the spark plug for use in internal combustion engine have become less than those of the prior art. On the other hand, the more suppression of the decrease of the electrode of the spark plug for use in internal combustion engine by the spark discharge is desired from the viewpoint to improve the durability.

As the spark plug for use in internal combustion engine stressing the suppression of the decrease of the electrode by the spark discharge more than the improvements in the sulfur resistance and the resistance to the lead corrosion, therefore, there is known the spark plug for use in internal combustion engine (as referred to JP-A-2004-206892, for example) using an electrode material, which contains Si in 0.5 to 1.5 wt. %, Al in 0.5 to 1.5 wt. %, at least one of Y, Nd and Sm in 0.05 to 0.5 wt. %, and Cr and Mn in 0.8 wt. % or less in total, and the remainder being Ni and an unavoidable impurity, and which has a specific resistance of 25 μΩcm or less at the room temperature (at about 20° C.).

SUMMARY OF THE INVENTION

In the prior art, the electrode material for the spark plug for use in internal combustion engine is demanded not only to improve the sulfur resistance, the resistance to lead corrosion and the resistance to hot oxidation but also to have a little decrease by the spark discharge. In recent years, on the other hand, the sulfur component and the lead component in the fuel so that the less decrease by the spark discharge is accepted more important than the improvement in the lead corrosion resistance.

Here, the metal shell of the spark plug for use in internal combustion engine is plated so as to prevent the rust. This plating is generally done with nickel. This nickel plating is excellent in the heat resistance so that it is suitably used in the metal shell to be employed at the high temperature, but is not always sufficient for the rust prevention. Therefore, investigations have been made to perform the zinc plating excellent in the rust prevention in place of the nickel plating.

However, the zinc plating is difficult to execute, because the hydrogen generated at the plating step exerts adverse affects on the electrode material. In the electrode material having its specific resistance lowered to suppress the aforementioned decrease by the spark discharge, more specifically, the additional component is reduced to lower the specific resistance. This raises a tendency that the crystal grains composing the electrode material become coarse.

In case the crystal grains are small, the grain boundaries to be formed between the crystal grains are complexly entangled so that they can prevent the penetration of oxygen from the outside when the electrode material is employed at a high temperature, thereby to suppress the breakage. In case the crystal grains become coarse, as described hereinbefore, on the other hand, the grain boundaries between the crystal grains take a relatively simple structure so that the oxygen easily penetrates from the outside, when the electrode material is employed at the high temperature, thereby to cause the breakage easily by the oxidation.

Therefore, Y or the like for suppressing the growth of the crystal grains is added to the electrode material having a reduced specific resistance so as to suppress the oxidation due to the coarse crystal grains. However, the electrode material containing Y easily occludes hydrogen so that it is made brittle by occluding hydrogen.

Generally, the metal shell is plated while the ground electrode being jointed thereto. In case, therefore, the ground electrode is made from the aforementioned electrode material having the property to occlude hydrogen, the ground electrode occludes the hydrogen generated at the zinc plating time so that it becomes brittle. In case, therefore, the electrode material having the property to occlude hydrogen is used, it is difficult to execute the zinc plating.

The invention has been conceived to solve the problems thus far described, and has an object to provide a spark plug for an internal combustion engine made excellent in durability by suppressing the decrease of an electrode by a spark discharge and capable of being plated with zinc for excellent rust prevention.

According to the invention, there is provided a spark plug for an internal combustion engine, comprising: a cylindrical metal shell; a cylindrical insulator provided in the inner hole of the metal shell; a center electrode provided in the leading end side inner hole of the insulator; and a ground electrode having one end bonded to the leading end side of the metal shell and having another end face forming a spark discharge gap together with the center electrode, wherein at least the ground electrode comprises an electrode material, which contains Si in 0.5 wt. % or more and 1.5 wt. % or less, Al in 0.5 wt. % or more and 1.5 wt. % or less, at least one of Ti, V, Zr, Nb and Hf in 0.02 wt. % or more and 1.0 wt. % or less in total, C in 0.03 wt. % or more and 0.09 wt. % or less, and Ni in 95.5 wt. % or more, and which has a specific resistance at 20° C. of 25 μΩcm or less.

The electrode material in the invention may contain at least one of Cr and Mn in 0.5 wt. % in total. Moreover, the electrode material in the invention is preferred to contain at least such one kind of Ti, V, Zr, Nb and Hf as is selected from Zr and Hf. This electrode material containing Zr may contain at least one of Ti, V, Nb and Hf.

On the other hand, the electrode material containing Hf is preferred to contain Hf in 0.2 wt. % or more. The electrode material containing Hf may contain at least one of Ti, V, Zr and Nb. In this case, the electrode material is preferred to contain Hf the most in weight of Ti, V, Zr, Nb and Hf.

The electrode material containing Hf is preferred to contain Zr especially of Ti V, Zr and Nb. In this case, the weight ratio (Hf/Zr) of the content of Hf to the content of Zr is preferred to be 3 or more and 11 or less. The electrode material containing Hf and Zr may further contain at least one of Ti, V and Nb. In this case, the weight ratio (Hf/(Ti+V+Nb)) of the content of Hf to the total content of Ti, V and Nb is preferred to be 2 or more.

This electrode material in the invention is preferred to have an average crystal grain diameter of 300 μm or less after it was held at 900° C. for 100 hours. Moreover, the metal shell in the spark plug for use in internal combustion engine of the invention is preferably plated with zinc to have a thickness of 3 μm or more.

According to the invention, at least ground electrode of the spark plug for use in internal combustion engine is enabled to suppress the decrease of the electrode due to the spark discharge and to have an excellent durability by using an electrode material made from an Ni-alloy having a predetermined composition and specific resistance, to apply the zinc plating excellent in the rust prevention thereby to make the rust prevention excellent.

BRIEF DESCRIPTION OF THE DRAWINGS

FIG. 1 is a sectional view showing one embodiment of a spark plug for use in internal combustion engine according to the invention.

DESCRIPTION OF THE REFERENCE NUMERALS AND SIGNS

1 - - - Metal Shell
2 - - - Insulator
3 - - - Center Electrode (31 - - - Thermally Conductive Core, 32 - - - Coated Portion)
4 - - - Ground electrode
100 - - - Spark plug for use in internal combustion engine

DETAILED DESCRIPTION OF THE INVENTION

A spark plug for an internal combustion engine according to the invention is described in the following.

FIG. 1 is a sectional view showing one embodiment of the spark plug for the internal combustion engine of the invention. A spark plug 100 for use in an internal combustion engine is constructed to include: a cylindrical metal shell 1; an insulator 2 fitted in the metal shell 1 to protrude on its leading end side; a center electrode 3 fitted in the insulator 2 to protrude on its leading end side; and a ground electrode 4 bonded at its one end to the metal shell 1 by a welding or the like and bent back at its another end side toward the center electrode 3. A clearance is formed as a spark discharge gap g between the center electrode 3 and the ground electrode 4 confronting each other.

The metal shell 1 is formed of a low-carbon steel or the like into a generally cylindrical shape. This metal shell 1 includes: a flanged portion 11 protruding in the radial direction; a fixture engaging portion 12 having a hexagonal section and adapted to engage with a fixture such as a spanner when the spark plug 100 for use in internal combustion engine is to be mounted in the cylinder head or the like of the not-shown engine; and a leading end portion 13 positioned on the leading end side of the flanged portion 11 and having a smaller diameter than that of the flanged portion 11. In the outer circumference of the leading end portion 13, there is formed a threaded portion 14 for fastening the spark plug 100 in the cylinder head or the like of the engine. The fixture engaging portion 12 is provided on its base end side with an additional fastening portion 15 for additionally fixing to fix the insulator 2 in the metal shell 1.

On the other hand, the insulator 2 is made from a sintered ceramic member such as alumina or aluminum nitride and has an axial hole 2H formed along its own axial direction for fitting the center electrode 3. In this axial hole 2H, the center electrode 3 is bonded to the leading end side, and a terminal fixture 5 is bonded to the base end side. In this axial hole 2H, a resistor 6 is provided between the center electrode 3 and the terminal fixture 5. This resistor 6 is electrically connected through a glass seal 7 with the center electrode 3 and the terminal fixture 5.

The insulator 2 is provided with a radially bulging portion 21, which has a base end portion 22 formed on its base end side to have a smaller diameter than that of the bulging portion 21. On the other hand, the bulging portion 21 has an intermediate trunk portion 23 formed on its leading end side to have a smaller diameter than that of the bulging portion 21 and a leg portion 24 formed on the farther leading end side.

The center electrode 3 includes a thermally conductive core 31 made from copper or the like and a coated portion 32, and is provided such that the leading end of the coated portion 32 protrudes to the leading end side from the leading end of the insulator 2. On the other hand, the ground electrode 4 has one end bonded to the leading end side of the metal shell 1 and is bent back at its another end side toward the center electrode 3. The ground electrode 4 is provided to confront the leading end portion of the center electrode 3. For a rust prevention, it is preferred that the metal shell 1 has a surface zinc-plated to have a zinc-plated layer and further treated with chromate, although not shown. This zinc-plated layer (including the chromate layer) is preferred to have a thickness of 3 μm or more for the rust prevention.

Of the center electrode 3 and the ground electrode 4 in this spark plug 100 according to the invention, at least the ground electrode 4 is made from the following electrode materials. Here, the center electrode 3 and the ground electrode 4 need not be wholly made from the following electrode materials. In this embodiment, for example, the center electrode 3 is constructed to include the thermally conductive core 31 and the coated portion 32, as described hereinbefore. However, this coated portion 32 is made from an electrode material of the same quality as that of the ground electrode 4.

In this invention, especially the ground electrode 4 is made from the following electrode materials so that the zinc plating can be done in an excellent rust prevention. More specifically, the metal shell 1 is generally plated such that the ground electrode 4 is jointed to the metal shell 1. In case, therefore, the ground electrode 4 is made from such an electrode material as occludes hydrogen, the zinc plating to produce hydrogen is difficult because the ground electrode 4 occludes the produced hydrogen and becomes brittle.

Therefore, at least the ground electrode 4 is constructed by using such an electrode material capable of being plated with zinc as is described in the following. Even in case the ground electrode 4 is zinc-plated while being jointed to the metal shell 1, the ground electrode 4 can be prevented from occluding hydrogen and becoming brittle, so that it can be zinc-plated excellently in the rust prevention.

The electrode material to be used in the spark plug 100 of the invention contains Si in 0.5 wt. % or more and 1.5 wt. % or less, Al in 0.5 wt. % or more and 1.5 wt. % or less, At least one of Ti, V, Zr, Nb and Hf totally in 0.02 wt. % or more and 1.0 wt. % or less, C in 0.03 wt. % or more and 0.09 wt. % or less, and Ni in 95.5 wt. % or more, and has a specific resistance at 20° C. of 25 μΩcm or less.

If the specific resistance of the electrode material at 20° C. is higher than 25 μΩcm, the center electrode 3 and the ground electrode 4 rise in temperatures at the spark discharging time so that they are prematurely exhausted to lower their durabilities. In the invention, therefore, the electrode materials to be used for the center electrode 3 and the ground electrode 4 are set to have specific resistances of 25 μΩcm or less at 20° C. so that the center electrode 3 and the ground electrode 4 can be improved in durabilities. Here, the specific resistance of the electrode material for the ground electrode 4 is decided with the value which has been measured with respect to the ground electrode 4 not jointed to the metal shell 1.

In order to satisfy the corrosion-resistance and the high-temperature oxidation resistance required at the minimum for that electrode material, moreover, the additional component to be contained in Ni is adjusted. If this addition is excessive, however, some additional component may rise in the specific resistance at 20° C. Therefore, the additional component is adjusted to prepare the electrode material which can satisfying the demands for the corrosion resistance and the high-temperature anti-oxidation while keeping the specific resistance at 20° C. to 25 μΩcm or less.

In the prior art, specifically, the protective oxide film is formed by containing Si and Al while reducing the contents of Cr and Mn and by containing at least one of Ti, V, Zr, Nb and Hf even with small contents of Si and Ai so as to reinforce the protective oxide film. These individual components are described on their actions in the following.

Cr and Mn improve the corrosion resistance and the oxidation resistance by forming the protective oxide film on the surface of the electrode material. If these contents increase, however, the specific resistance at 20° C. increases. Therefore, Cr and Mn are made not to exceed 0.5 wt. % in their total content. Here, Cr and Mn are not the essential components, but neither of them can be contained. In case Cr and Mn are contained, moreover, both or one of them may be contained.

Si forms the protective oxide film on the surface electrode material thereby to improve the corrosion resistance and the oxidation resistance, and is contained within a range from 0.5 wt. % to 1.5 wt. %. Si cannot achieve its effect sufficiently, if its content is less than 0.5 wt. %, but rises in the specific resistance at 20° C. so that its effect to suppress the decrease of the electrode material cannot be sufficiently attained, if its content exceeds 1.5 wt. %.

Like Si, Al forms a protective oxide film on the surface of the electrode material thereby to improve the corrosion resistance and the oxidation resistance, and is contained within a range from 0.5 wt. % to 1.5 wt. %. Al cannot achieve its effect sufficiently, if its content is less than 0.5 wt. %, but rises in the specific resistance at 20° C. so that its effect to suppress the decrease of the electrode material cannot be sufficiently attained, if its content exceeds 1.5 wt. %.

Ti, V, Zr, Nb and Hf facilitate the formation of $Al_2O_3$ or the protective oxide film thereby to improve the corrosion resistance and the oxidation resistance, even if the total content of Cr and Mn is not more than 0.5 wt. %. When N and Al having penetrated into the electrode material are bonded into AlN, the formation of the protective oxide film $Al_2O_3$ on the surface of the electrode material is delayed so that oxidation resistance cannot be retained. However, it is thought that at least one of Ti, V, Zr, Nb and Hf is contained to fix N having penetrated into the electrode material thereby to prevent Al in the electrode material from becoming AlN. As a result, the formation of the protective oxide film $Al_2O_3$ is facilitated to improve the oxidation resistance.

Moreover, Ti, V, Zr, Nb and Hf make the electrode material, even if exposed to a high temperature, hard to crack and break. In the electrode material, crystal grains glow, when exposed to a high temperature, so that the grain boundaries formed inbetween change from a complicated structure into a relatively simple structure. When the grain boundaries thus take the relatively simple structure, the oxidation easily proceeds deeply into the grain boundaries so that the electrode material is easily cracked and broken. By containing at least one of Ti, V, Zr, Nb and Hf, however, their carbides separate out into the grain boundaries to suppress the growth of crystal grains. Therefore, the grain boundary oxidation can be prevented from proceeding deeply into the inside thereby to make the cracking and the breakage hard.

By containing at least one of Ti, V, Zr, Nb and Hf, according to the invention, it is possible to execute the zinc plating excellent in the rust prevention, which has been difficult for the prior art with the content of Y.

Specifically, the electrode material of the prior art having the reduced specific resistance is so made to contain Y or the like in the Ni-based alloy as to prevent the crystal grains from becoming coarse into the relatively simple structure. If the Ni-based alloy contains Y, it easily occludes hydrogen and becomes brittle with the occluded hydrogen. Generally, the metal shell 1 is plated with the ground electrode 4 being jointed thereto. In case, therefore, the ground electrode 4 is made from the electrode material easily occluding hydrogen, the metal shell 1 easily generates hydrogen, when subjected to the zinc plating, so that the ground electrode 4 occludes the generated hydrogen and becomes brittle.

In the invention, at least one of Ti, V, Zr, Nb and Hf is contained in place of the Y or the like, so that it can prevent the electrode material from occluding hydrogen and becoming brittle. It is, therefore, possible to perform the zinc plating excellent in the rust prevention.

The total content of Ti, V, Zr, Nb and Hf is 0.02 wt. % or more and 1.0 wt. % or less. If this content is less than 0.02 wt. %, the aforementioned effects to suppress the formation of the AlN and to suppress the crystal grain growth are not sufficient. If the content exceeds 1.0 wt. %, on the other hand, the efficiencies may drop in the operation to draw an element wire for manufacturing the ground electrode 4, in the plastic working operation to fill the thermally conductive member 31 of copper or the like in the center electrode 3, and so on. The aforementioned content is preferably 0.05 wt. % or more from the viewpoint of better improving the effects to suppress the AlN formation and the crystal grain growth. On the other hand, the content is more preferably 0.6 wt. % or less from the view point of the plastic workability or the like.

Here, Zr is lower in the solid solution limit to Ni than the remaining elements (Ti, V, Nb and Hf), and easily separates out into the grain boundaries so that it has a high effect to suppress the crystal grain growth. In other words, the metallic elements (Ti, V, Nb and Hf) other than Zr have higher solid solution limits to Ni than Zr and are hard to separate out into the grain boundaries so that they have lower effects to suppress the crystal grain growth than that of Zr. In case, therefore, the metallic elements (Ti, V, Nb and Hf) other than Zr are exclusively contained, it is preferred that their total content is 0.2 wt. % or more. Even in case the metallic elements (Ti, V, Nb and Hf) other than Zr are thus exclusively contained, the upper limit of the content is 1.0 wt. % or less, preferably 0.6 wt. % or less.

Of these, Hf hardly drops in the partial characteristics or effects unlike the remaining metallic elements (Ti, V, Nb and Hf) in dependence upon the content, and is not especially limited within the content range of 0.2 wt. % or more and 1.0 wt. % or less, as defined above. Thus, Hf is preferred because it can be contained in a necessary quantity.

For example, Ti may have an excessively high specific resistance, if its content is made to prevent the crystal grains from becoming coarse, thereby to invite a disadvantage in the spark decrease. V and Nb are preferably contained in about 0.5 wt. % from the point of improving the oxidation resistance. From the point of preventing the crystal grains from becoming coarse, however, the content is preferred to be slightly increased. This difference in the content may fail to achieve those two effects.

Zr is advantageous, even if less contained than the remaining metallic elements (Ti, V, Nb and Hf), for similar effects, as described hereinbefore. On the other hand, however, Zr is liable to change in characteristics even if its content is slightly changed, so that it is not necessarily preferred for the manufacture in the point that the strict control of its content is demanded. Moreover, Zr may become slightly low in the cold workability, if its content can attain the effect to compensate the oxidation resistance and to suppress the coarse crystal grains.

Thus, the metallic element other than Hf, that is, Ti, V, Nb and Hf may lower the partial characteristics or effects slightly in dependence upon their contents and may not easily balance all the characteristics or effects. On the contrary, Hf hardly lowers the partially characteristics or effects in dependence upon its content, but can be contained in a necessary quantity without any limit, so long as its content is within the range from 0.2 wt. % to 1.0 wt. %. It is, therefore, preferred to contain Hf especially of Ti, V, Zr, Nb and Hf.

From the viewpoint of acquiring the various effects thus far described, it is preferred that the content of Hf is 0.2 wt. % or more. Even in case Hf is thus contained, it is possible from the viewpoint of improving the characteristics better that the metallic elements (Ti, V, Zr and Nb) other than Hf can be contained. In this case, it is preferred that the content of Hf of Ti, V, Zr and Nb is made the most. As described hereinbefore, Hf hardly lowers the partial characteristics or effects in dependence upon its content so that the various characteristics can be well balanced by that major component.

In case not only Hf but also other metallic elements (Ti, V, Zr and Nb) are contained, it is preferred that Zr having the highest effect for the content is contained. By containing Zr together with Hf, the content can be made lower than that of the case, in which others are contained, while well balancing the various characteristics. It is preferred in this case that the weight ratio (Hf/Zr) of the content of Hf to the content of Zr is 3 or more and 11 or less. By setting the weight ratio to 3 or more and 11 or less, it is possible to make the oxidation resistance excellent, to reduce the decrease at the spark discharging time and to balance the characteristics well.

Together with Hf and Zr, moreover, there may be contained at least one of the remaining metallic elements Ti, V, and Nb. In this case, it is preferred that the weight ratio (Hf/(Ti+V+Nb)) of Hf to the total content of Ti, V, and Nb is 2 or more. Hf is effective to balance the various characteristics well. If the aforementioned weight ratio is less than 2, however, the content of Hf is reduced to make it difficult to balance the characteristics or effects well.

C is contained to enhance the mechanical strength at a high temperature. Specifically, the aforementioned Ni-based alloy can easily lower the high-temperature strength but is enabled to suppress deformation due to the thermal stress in use by adding C or the penetration type element. C is contained within a range from 0.03 wt. % to 0.09 wt. %. The mechanical strength at the high temperature is not sufficient, if the content of C is less than 0.03 wt. %, and the deformation resistance is high, if the content is more than 0.09 wt. %, there to make it difficult to fill the plastic working thereby to prepare the center electrode 3 by filling the thermally conductive member 31 of copper or the like.

Moreover, it is preferred that the electrode material is prepared to have such a composition after held in the atmosphere at 900° C. for 100 hours that the crystal grains have an average grain diameter of 300 μm or less. The crystal grains may invite, if their average diameter after held at 900° C. for 100 hours exceeds 300 μm, the electrode breakage due to the grain field oxidation.

EXAMPLES

The invention is described in detail in connection with examples.

First of all, the center electrode 3 and the ground electrode 4 of the spark plug 100 were fabricated by employing the electrode material which had the Ni-based alloy of the composition, as tabulated in the following Table 1, at the following steps.

Specifically, an ordinary vacuum melting furnace was used to prepare molten alloys having individual compositions into ingots by vacuum castings. After this, the ingots were hot-forged into round bars of a diameter of 60 mm. These round bars were drawn into element wires having a diameter of 4 mm and element wires having sectional sizes of 1.6 mm×2.8 mm. The thermally conductive members 31 of copper were fitted as cores in the former thereby to form the center electrodes 3, and the latter were used as the ground electrodes 4.

The ground electrode 4 was jointed at its one end portion by the resistance welding to the leading end portion of the metal shell 1 which had been formed into a predetermined shape by using a metallic raw material of low-carbon steel. After this, the ground electrode 4 was dipped in hydrochloric acid of about 10% to remove rust, oxides or chips of the cutting operations, and was rinsed with water. After this, the metal shell 1 integrated with the ground electrode 4 was barrel-plated with the zinc-plated layer, and was then treated with chromate. The zinc-plated layer thus treated with the chromate had a thickness of 3 μm. In only Example 16, a nickel-plated layer was formed in place of the zinc-plated layer.

On the other hand, the center electrode 3 was assembled in the axial hole 2H of the insulator 2 by the well-known method and was sealed with glass, and the resistor 6 and the terminal fixture 5 were assembled. Then, the spark plug 100 was prepared by assembling the insulator 2 with the metal shell 1 integrated with the ground electrode 4 and by folding back the leading end portion of the ground electrode 4 toward the center electrode 3 to confront the leading end portion of the center electrode 3.

Here in the spark plugs 100 of Examples 1 to 25, the compositions and the specific resistances of the electrode materials making the center electrode 3 (i.e., the coated portion 32) and the ground electrode 4 are within the scope of the invention. In the spark plugs 100 of Comparisons 1 to 10 and the prior art, moreover, the compositions of the electrode materials making the center electrode 3 (i.e., the coated portion 32) and the ground electrode 4 are within the scope of the invention.

TABLE 1

| | Composition (wt. %) | | | | | | | Specific Resistance | |
|---|---|---|---|---|---|---|---|---|---|
| | Si | Al | Cr | Mn | C | Ti, V, Nb, Zr, Hf | Ni + Others | (μΩcm) | Plating of Metal Shell |
| Example 1 | 1.0 | 1.0 | 0.0 | 0.2 | 0.05 | Ti0.5, Nb0.5 | Residual | 24 | Zn-Plated with Chromate |
| Example 2 | 1.0 | 1.0 | 0.0 | 0.2 | 0.03 | Ti0.3 | Residual | 20 | Zn-Plated with Chromate |
| Example 3 | 1.0 | 1.0 | 0.0 | 0.2 | 0.05 | V0.5 | Residual | 19 | Zn-Plated with Chromate |
| Example 4 | 1.0 | 1.0 | 0.0 | 0.2 | 0.05 | Nb0.6 | Residual | 19 | Zn-Plated with Chromate |
| Example 5 | 1.0 | 1.0 | 0.0 | 0.2 | 0.05 | Zr0.05 | Residual | 19 | Zn-Plated with Chromate |
| Example 6 | 1.0 | 1.0 | 0.0 | 0.2 | 0.05 | Zr0.3 | Residual | 18 | Zn-Plated with Chromate |
| Example 7 | 1.5 | 1.0 | 0.0 | 0.2 | 0.05 | Zr0.2 | Residual | 21 | Zn-Plated with Chromate |
| Example 8 | 1.0 | 0.5 | 0.0 | 0.2 | 0.05 | Zr0.2 | Residual | 18 | Zn-Plated with Chromate |
| Example 9 | 1.0 | 1.5 | 0.0 | 0.2 | 0.05 | Zr0.2 | Residual | 20 | Zn-Plated with Chromate |
| Example 10 | 1.0 | 1.0 | 0.0 | 0.0 | 0.05 | Zr0.2 | Residual | 18 | Zn-Plated with Chromate |
| Example 11 | 1.0 | 1.0 | 0.5 | 0.0 | 0.05 | Zr0.2 | Residual | 23 | Zn-Plated with Chromate |
| Example 12 | 1.0 | 1.0 | 0.0 | 0.5 | 0.05 | Zr0.2 | Residual | 20 | Zn-Plated with Chromate |
| Example 13 | 1.0 | 1.0 | 0.0 | 0.2 | 0.09 | Zr0.2 | Residual | 19 | Zn-Plated with Chromate |
| Example 14 | 1.0 | 1.0 | 0.2 | 0.0 | 0.05 | Zr0.1, Nb0.6 | Residual | 20 | Zn-Plated with Chromate |
| Example 15 | 1.0 | 0.7 | 0.0 | 0.0 | 0.05 | Hf0.2 | Residual | 18 | Zn-Plated with Chromate |
| Example 16 | 1.0 | 1.0 | 0.0 | 0.2 | 0.05 | Hf0.4 | Residual | 19 | Ni-Plated Electrolytic Chromate |
| Example 17 | 1.0 | 1.0 | 0.0 | 0.2 | 0.05 | Hf1.0 | Residual | 20 | Zn-Plated with Chromate |
| Example 18 | 1.0 | 1.0 | 0.0 | 0.2 | 0.05 | Hf0.2, Nb0.4 | Residual | 20 | Zn-Plated with Chromate |
| Example 19 | 1.0 | 1.0 | 0.0 | 0.2 | 0.05 | Hf0.4, Ti0.2 | Residual | 20 | Zn-Plated with Chromate |
| Example 20 | 1.0 | 1.0 | 0.0 | 0.2 | 0.05 | Hf0.2, Zr0.1 (Hf/Zr = 2) | Residual | 18 | Zn-Plated with Chromate |
| Example 21 | 1.0 | 1.0 | 0.0 | 0.2 | 0.05 | Hf0.3, Zr0.1 (Hf/Zr = 3) | Residual | 18 | Zn-Plated with Chromate |
| Example 22 | 1.0 | 1.0 | 0.0 | 0.2 | 0.05 | Hf0.55, Zr0.05 (Hf/Zr = 11) | Residual | 21 | Zn-Plated with Chromate |
| Example 23 | 1.0 | 1.0 | 0.0 | 0.2 | 0.05 | Hf0.6, Zr0.05 (Hf/Zr = 12) | Residual | 19 | Zn-Plated with Chromate |
| Example 24 | 1.0 | 1.0 | 0.0 | 0.2 | 0.05 | Hf0.3, Zr0.1, V0.1 (Hf/Zr = 3, Hf/V = 3) | Residual | 20 | Zn-Plated with Chromate |
| Example 25 | 1.0 | 1.0 | 0.0 | 0.2 | 0.05 | Hf0.3, Zr0.05, Nb0.2 (Hf/Zr = 6, Hf/Nb = 1.5) | Residual | 20 | Zn-Plated with Chromate |
| Comparison 1 | 1.0 | 0.7 | 0.0 | 0.0 | 0.05 | Hf0.03 | Residual | 17 | Zn-Plated with Chromate |
| Comparison 2 | 1.0 | 0.7 | 0.0 | 0.0 | 0.05 | Hf2.0 | Residual | 24 | Zn-Plated with Chromate |
| Comparison 3 | 2.0 | 1.0 | 0.0 | 0.2 | 0.05 | Hf0.4 | Residual | 30 | Zn-Plated with Chromate |
| Comparison 4 | 0.2 | 1.0 | 0.0 | 0.2 | 0.05 | Hf0.4 | Residual | 19 | Zn-Plated with Chromate |
| Comparison 5 | 1.0 | 2.0 | 0.0 | 0.2 | 0.05 | Hf0.4 | Residual | 28 | Zn-Plated with Chromate |
| Comparison 6 | 1.0 | 0.2 | 0.0 | 0.2 | 0.05 | Hf0.4 | Residual | 19 | Zn-Plated with Chromate |
| Comparison 7 | 1.0 | 1.0 | 0.5 | 0.5 | 0.05 | Hf0.4 | Residual | 32 | Zn-Plated with Chromate |
| Comparison 8 | 1.0 | 1.0 | 0.0 | 0.2 | 0.11 | Hf0.4 | Residual | 20 | Zn-Plated with Chromate |
| Comparison 9 | 1.0 | 1.0 | 0.0 | 0.2 | 0.01 | Hf0.4 | Residual | 20 | Zn-Plated with Chromate |
| Comparison 10 | 1.0 | 0.7 | 0.0 | 0.0 | 0.05 | Y0.25 | Residual | 18 | Zn-Plated with Chromate |
| Prior Art | 1.5 | — | 1.5 | 2.0 | 0.003 | — | Residual | 34 | Zn-Plated with Chromate |

Next, the spark plugs 100 were subjected to the following tests and measurements, and their characteristics were evaluated. The evaluation results are tabulated in Table 2. For the "center electrode deformability tests" indicating the deformation durability against the thermal cycles and the "plastic workability" indicating the workability, the center electrode 3 was used as the test evaluation piece. However, the electrode material failing to satisfy those test evaluation standards was decided to be difficult in the application as the ground electrode 4.

(60,000 Km Corresponding Tests for Electrode Gap Increase)

The spark plugs 100 of the individual Examples and Comparisons and the prior art were used and tested in the six-cylinder and 2.8 litter engine for the run of about 400 hours (corresponding to a run of 60,000 Km at a speed of 150 Km/hour). The measurements were made on the increases in the spark discharge gap g before and after the tests.

In the evaluation standards: the samples having an increase of less than 0.30 mm in the spark discharge gap g were evaluated as "O" because they were excellent with little electrode decrease; the samples having an increase of 0.30 mm or more and less than 0.35 mm were evaluated as "Δ" because they were fair; and the samples having an increase of 0.35 mm or more were evaluated as "X" because they were failure.

(Measurements of Oxide Film Thickness)

The spark plugs 100 of the individual Examples and Comparisons and the prior art were used in the four-cylinder and 2.0 litter engine. The cycles of running the engine at 5,000 rpm for 1 minute and idling the same (at 700 to 800 rpm) for 1 minute were repeated for 100 hours. After this, the ground electrode 4 was cut in the longitudinal direction, and the oxide film thickness was measured. Here, the highest temperature of the engine was 950° C., and the measurement of the oxide film thickness contained the thickness of the grain boundary oxidation, if found.

In the evaluation standards: the samples of the ground electrode 4 having, after tested, the oxide film thickness less than 180 μm were evaluated as "O" because they did not have excessive formation of the oxide film and were excellent; the samples of 180 μm or more and less than 210 μm were evaluated as "Δ" because they were fair; and the samples of 210 μm or more were evaluated as "X" because they were failure. When the oxide film was excessively thick, the electrode itself easily rose in temperature. Therefore, the preferable thickness was less than 210 μm, and the more preferable thickness was less than 180 μm.

(Center Electrode Deformation Tests)

The spark plugs 100 of the individual Examples and Comparisons and the prior art were used, and the cycles of heating the leading end of the center electrode 3 at 850° C. for 3 minutes and cooling the same for 1 minute were repeated. The number of cycles was counted till the length of the center electrode 3 became shorter by 0.1 mm than the initial one.

In the evaluation standards: the samples of the cycle number of 2,500 or more till the length of the center electrode 3 became shorter by 0.1 mm than the initial one were evaluated as "O" because the deformation of the center electrode 3 was little and was excellent; the samples of 1,500 cycles or more and less than 2,500 cycles were evaluated as "Δ" because they were fair; and the samples of less than 1,500 cycles were evaluated as "X" because they were failure.

(Brittleness Tests)

The ground electrodes 4 of the spark plugs 100 of the individual Examples and Comparisons and the prior art were repeatedly extended and folded, and the number of times till the ground electrodes 4 were broken was counted. Here, the actions to fold the ground electrode 4 by 90 degrees from the straight state toward the center electrode 3 and to bend back the same again to the straight state were counted by one.

In the evaluation standards: the samples of the counted number of 6 or more till the ground electrode 4 was broken were evaluated as "O" because they were made little brittle by the hydrogen occlusion; the samples of the counted number of 3 to 5 were evaluated as "Δ" because they were fair; and the samples of the counted number of 2 were evaluated as "X" because they were failure.

(Brine Spray Tests)

The spark plugs 100 of the individual Examples and Comparisons and the prior art were subjected to the brine spray tests under the conditions of JIS H8502, and the time period till red rust formed. In the evaluation standards : the samples of the time period of 96 hours or longer till the red rust formed were evaluated as "O" because they were excellent in the rust prevention; the samples of the time period of 48 hours or longer and shorter than 96 hours were evaluated as "Δ" because they were fair; and the samples of the time period shorter than 48 hours were evaluated as "X" because they were failure.

(Plastic Workability)

When the center electrodes 3 of the spark plugs 100 of the individual Examples and Comparisons and the prior art were prepared, there was examined the workability of fitting the thermally conductive members 3 of copper as the cores in the aforementioned electrode materials (to become the coated portions 32).

In the evaluation standards: the samples having no working crack in the coated portions 32 when the thermally conductive members 31 were fitted in the aforementioned electrode materials and having no clearance found between the coated portions 32 and the thermally conductive members 31 were evaluated as "O" because they were excellent in the plastic workability; the samples having the working crack and the clearance formed between the coated portions 32 and the thermally conductive members 31 were evaluated as "X" because they were failure.

(Measurements of Average Crystal Grain Diameter)

The spark plugs 100 of the individual Examples and Comparisons and the prior art were subjected to heat treatments by an electric furnace in the atmosphere, at 900° C. for 100 hours. After this, the ground electrodes 4 were cut in the longitudinal direction, and the average crystal grain diameter was measured. In these measurements of the average crystal grain diameter, the half sections of the ground electrode 4 at a portion to confront the center electrode 3 were polished and corroded so that the grain boundary was exposed as the measurement face. For this measurement face, an optical microscope was used to measure the number of crystal grains per unit area so that the average crystal grain diameter was calculated from the crystal grain number per unit area.

TABLE 2

| | Average Crystal Grain Diameter (μm) | | Electrode Gap | Oxide Film | Center Electrode | | | |
|---|---|---|---|---|---|---|---|---|
| | Initial | after Heat Treatment 900° C. × 100 h | Increase after 60,000 Km Corresponding Test | Thickness after 900° C. × 100 h | Deformation Test (Thermal Cycles) | Brittleness Test | Brine Spray Test | Plastic Workability |
| Example 1 | 35 | 300 | ○ (0.28 mm) | ○ (160 μm) | ○ | ○ | ○ | ○ |
| Example 2 | 60 | 400 | ○ (0.26 mm) | Δ (200 μm) | ○ | ○ | ○ | ○ |
| Example 3 | 60 | 250 | ○ (0.25 mm) | ○ (160 μm) | ○ | ○ | ○ | ○ |
| Example 4 | 30 | 280 | ○ (0.25 mm) | ○ (150 μm) | ○ | ○ | ○ | ○ |
| Example 5 | 60 | 350 | ○ (0.25 mm) | Δ (200 μm) | ○ | ○ | ○ | ○ |
| Example 6 | 10 | 280 | ○ (0.23 mm) | ○ (140 μm) | ○ | ○ | ○ | ○ |

TABLE 2-continued

| | Average Crystal Grain Diameter (μm) | | Electrode Gap | Oxide Film | Center Electrode | | | |
|---|---|---|---|---|---|---|---|---|
| | Initial | after Heat Treatment 900° C. × 100 h | Increase after 60,000 Km Corresponding Test | Thickness after 900° C. × 100 h | Deformation Test (Thermal Cycles) | Brittleness Test | Brine Spray Test | Plastic Workability |
| Example 7 | 10 | 240 | ○ (0.28 mm) | ○ (100 μm) | ○ | ○ | ○ | ○ |
| Example 8 | 10 | 240 | ○ (0.23 mm) | ○ (170 μm) | ○ | ○ | ○ | ○ |
| Example 9 | 10 | 280 | ○ (0.26 mm) | ○ (140 μm) | ○ | ○ | ○ | ○ |
| Example 10 | 10 | 240 | ○ (0.23 mm) | ○ (160 μm) | ○ | ○ | ○ | ○ |
| Example 11 | 10 | 230 | ○ (0.28 mm) | ○ (140 μm) | ○ | ○ | ○ | ○ |
| Example 12 | 10 | 260 | ○ (0.26 mm) | ○ (160 μm) | ○ | ○ | ○ | ○ |
| Example 13 | 10 | 200 | ○ (0.25 mm) | ○ (150 μm) | ○ | ○ | ○ | ○ |
| Example 14 | 10 | 240 | ○ (0.26 mm) | ○ (150 μm) | ○ | ○ | ○ | ○ |
| Example 15 | 30 | 300 | ○ (0.23 mm) | ○ (180 μm) | ○ | ○ | ○ | ○ |
| Example 16 | 10 | 280 | ○ (0.25 mm) | ○ (160 μm) | ○ | ○ | Δ | ○ |
| Example 17 | 10 | 240 | ○ (0.26 mm) | ○ (160 μm) | ○ | ○ | ○ | ○ |
| Example 18 | 10 | 280 | ○ (0.26 mm) | ○ (150 μm) | ○ | ○ | ○ | ○ |
| Example 19 | 10 | 280 | ○ (0.26 mm) | ○ (140 μm) | ○ | ○ | ○ | ○ |
| Example 20 | 10 | 280 | ○ (0.22 mm) | ○ (150 μm) | ○ | ○ | ○ | ○ |
| Example 21 | 10 | 280 | ○ (0.22 mm) | ○ (130 μm) | ○ | ○ | ○ | ○ |
| Example 22 | 10 | 220 | ○ (0.26 mm) | ○ (130 μm) | ○ | ○ | ○ | ○ |
| Example 23 | 10 | 260 | ○ (0.23 mm) | ○ (150 μm) | ○ | ○ | ○ | ○ |
| Example 24 | 10 | 260 | ○ (0.24 mm) | ○ (130 μm) | ○ | ○ | ○ | ○ |
| Example 25 | 10 | 280 | ○ (0.25 mm) | ○ (140 μm) | ○ | ○ | ○ | ○ |
| Comparison 1 | 80 | 400 | ○ (0.25 mm) | x (240 μm) | ○ | ○ | ○ | ○ |
| Comparison 2 | 10 | 200 | Δ (0.31 mm) | ○ (160 μm) | ○ | ○ | ○ | x |
| Comparison 3 | 10 | 280 | x (0.37 mm) | ○ (100 μm) | ○ | ○ | ○ | ○ |
| Comparison 4 | 10 | 320 | ○ (0.25 mm) | x (260 μm) | ○ | ○ | ○ | ○ |
| Comparison 5 | 10 | 250 | x (0.35 mm) | ○ (140 μm) | ○ | ○ | ○ | ○ |
| Comparison 6 | 10 | 250 | ○ (0.24 mm) | x (250 μm) | ○ | ○ | ○ | ○ |
| Comparison 7 | 10 | 240 | x (0.38 mm) | ○ (140 μm) | ○ | ○ | ○ | ○ |
| Comparison 8 | 10 | 180 | ○ (0.25 mm) | ○ (170 μm) | ○ | ○ | ○ | x |
| Comparison 9 | 90 | 550 | ○ (0.25 mm) | x (230 μm) | x | ○ | ○ | ○ |
| Comparison 10 | 80 | 230 | ○ (0.23 mm) | ○ (140 μm) | ○ | x | ○ | ○ |
| Prior Art | 60 | 430 | x (0.40 mm) | x (220 μm) | ○ | ○ | ○ | ○ |

As apparent from Table 2, it has been found that many spark plugs 100 of Comparisons 1 to 10 or the prior art outside of the compositions or the specific resistances at 20° C. of the electrode materials of the invention caused, after used, the increase in the spark discharge gap g and the formation of the oxide film so that they could hardly satisfy all the characteristics at the same time. It has been judged that the spark plug 100 of Comparison 10 containing Y as the electrode material so that they could hardly manufacture the zinc-plated articles because they occluded hydrogen at the zinc-plating time so that the ground electrode 4 became brittle.

On the other hand, it has been found that the spark plugs 100 of Examples 1 and 2 having the composition of the electrode material and the specific resistance at 20° C. within the range of the invention could suppress the increase in the spark discharge gap g, after used, the excessive formation of the oxide film and the formation of coarser crystal grains. Moreover, it has also been found that the brittleness of the electrode material due to the hydrogen occlusion was suppressed so that the zinc plating could be excellent in the rust prevention. It has been additionally found that the plastic workability was sufficient for preparing the center electrode.

As to the metallic elements (Ti, V, Zr, Nb and Hf) to be contained in the electrode material, moreover, Zr is preferred because it can obtain a relatively satisfactory result even in a content as small as about 0.05 wt. %, as exemplified in Example 5 or the like. As exemplified in Examples 15 to 17 and so on, for example, the content of Hf is more than that of Zr, but it hardly reduces the characteristics or effects, even if its content is 0.2, 0.4 and 1.0 wt. %. Since Hf may be contained within a range of 0.2 to 1.0 wt. %, moreover, it can be said preferable from the manufacturing viewpoint in that its strict control is required unlike Zr and as the manufactured electrode.

In case Hf and the remaining metallic elements (Ti, V, Zr and Nb) are contained in the electrode material, the formation of the oxide film can be more suppressed by making the content of Hf more than those of the remaining individual metallic elements (Ti, V, Zr and Nb), if the content of Hf is equal to the total content of the remaining metallic elements (Ti, V, Zr and Nb). This composition is found preferable because the characteristics can be well balanced. Here, the formation of the oxide film has a tendency to depend on the content of Hf more on the contents of Nb and Ti. Examples 18 and 19 present the case, in which Nb or Ti is contained as a metallic element other than Hf.

Of the metallic elements (Ti, V, Zr and Nb) other than Hf, as contained together with Hf in the electrode material, it has been found, as exemplified in Embodiments 20 to 24, that Hf is preferable because satisfactory effects could be obtained even with a small content. In case Zr is thus contained together with Hf in the electrode material, it is found preferable that the formation of the oxide film can be more suppressed to balance the characteristics well, by setting the weight ratio (Hf/Zr) of the Hf content to the Zr content at 3 or more and at 11 or less, as exemplified in Examples 20 to 23.

In case Hf and Zr are contained together with the remaining metallic elements (Ti, V and Nb) in the electrode material, it is found preferable that the increase in the spark discharge gap g and the formation of the oxide film can be more suppressed to balance the characteristics well by setting the weight ratio (Hf/(Ti+V+Nb)) of the Hf content to the total content of Ti, V and Nb at 2 or more, as exemplified in Examples 24 and 25. Here, Examples 24 and 25 present one example of the case, in which V or Nb is contained as the metallic element other than Hf and Zr, respectively.

This application is based on Japanese Patent application JP 2005-24500, filed Jan. 31, 2005, and Japanese Patent application JP 2005-345337, filed Nov. 30, 2005, the entire contents of which are hereby incorporated by reference, the same as if set forth at length.

What is claimed is:

1. An electrode material for a spark plug comprising from 0.5 to 1.5 wt. % of Si, from 0.5 to 1.5 wt. % of Al, from 0.02 to 1.0 wt. % of at least one of Ti, V, Zr, Nb and Hf, from 0.03 to 0.09 wt. % of C, 95.5 wt. % or more of Ni, and 0.5 wt. % or less of Cr and Mn in total; and having a specific resistance at 20° C. of 25 μΩcm or less, wherein said electrode material has an initial average crystal grain diameter of 35 μm or less and has an average crystal grain diameter of 300 μm or less after being held at 900° C. for 100 hours.

2. The electrode material according to claim 1, wherein said electrode material contains Zr.

3. The electrode material according to claim 1, wherein said electrode material contains Zr and at least one of Ti, V, Nb and Hf.

4. The electrode material according to claim 1, wherein said electrode material contains 0.2 wt. % or more of Hf.

5. The electrode material according to claim 4, wherein said electrode material contains at least one of Ti, V, Zr and Nb, and an amount of a weight of Hf contained in said electrode material is larger than an amount of a weight of each of Ti, V, Zr and Nb contained in said electrode material.

6. The electrode material according to claim 5, wherein said electrode material contains Zr.

7. The electrode material according to claim 6, wherein a weight ratio of a content of Hf contained in said electrode material to a content of Zr contained in said electrode material is from 3 to 11.

8. The electrode material according to claim 6, wherein said electrode material contains at least one of Ti, V and Nb, and a weight ratio of a content of Hf contained in said electrode material to a total content of Ti, V and Nb contained in said electrode material is 2 or more.

9. A spark plug comprising the electrode material according to claim 1 further comprising a metal shell having a plated layer containing zinc and having a thickness of 3 μm or more.

* * * * *